US009469431B2

(12) United States Patent
Benigni et al.

(10) Patent No.: US 9,469,431 B2
(45) Date of Patent: Oct. 18, 2016

(54) STORAGE BOX HAVING INTEGRAL LID WITH CLOSURE FLAPS

(75) Inventors: Stephen Benigni, Algonquin, IL (US); Paul Connolly, Westfield, MA (US); Matthew Swenson, Wood Dale, IL (US); Mark Sommerlot, Cedar Falls, IA (US); Jerry Klaus, St. Charles, IL (US); Marie Klaus, legal representative, St. Charles, IL (US)

(73) Assignee: Fellowes, Inc., Itasca, IL (US)

( * ) Notice: Subject to any disclaimer, the term of this patent is extended or adjusted under 35 U.S.C. 154(b) by 537 days.

(21) Appl. No.: 13/581,431

(22) PCT Filed: Feb. 25, 2011

(86) PCT No.: PCT/US2011/026235

§ 371 (c)(1),
(2), (4) Date: Feb. 11, 2013

(87) PCT Pub. No.: WO2011/106638

PCT Pub. Date: Sep. 1, 2011

(65) Prior Publication Data

US 2014/0054359 A1 Feb. 27, 2014

Related U.S. Application Data

(60) Provisional application No. 61/308,698, filed on Feb. 26, 2010.

(51) Int. Cl.

| | |
|---|---|
| ***B65D 5/42*** | (2006.01) |
| ***B65D 5/36*** | (2006.01) |
| ***B65D 5/468*** | (2006.01) |
| ***B65D 5/66*** | (2006.01) |

(52) U.S. Cl.

CPC ..... *B65D 5/4208* (2013.01); *B65D 5/3621* (2013.01); *B65D 5/4608* (2013.01); *B65D 5/6605* (2013.01); *B65D 5/6608* (2013.01)

(58) Field of Classification Search

CPC B65D 5/4608; B65D 5/0227; B65D 5/0281; B65D 2571/0045; B65D 5/433; B65D 2571/00524; B65D 5/10; B65D 5/22

USPC ..... 229/117.16, 117, 117.17, 117.25, 229/117.15

See application file for complete search history.

(56) References Cited

U.S. PATENT DOCUMENTS 1,673,109 A * 6/1928 Fenstermacher ..... 229/132
2,757,849 A 8/1956 Duff, Jr.

(Continued)

FOREIGN PATENT DOCUMENTS

WO WO 2009134427 A1 * 11/2009 ..... B65D 5/3614

OTHER PUBLICATIONS

Extended European Search Report, dated Apr. 4, 2015, for European Patent Application No. EP 11 74 8142.

*Primary Examiner* — Christopher Demeree
(74) *Attorney, Agent, or Firm* — Wood, Phillips, Katz, Clark & Mortimer

(57) ABSTRACT

A box having two opposed end panels having handholds, two opposed side panels, and a bottom, assembled to form a box having an opening for receiving contents therein, the box including a top panel for closing the opening, the top panel being hingedly connected to a side panel, and including a pair of closure flaps extending from the side of the top panel, the closure flaps positioned to be inserted into the handholds when the top panel is positioned to close the box.

2 Claims, 7 Drawing Sheets

(56) References Cited

U.S. PATENT DOCUMENTS

| | | | | | |
|---|---|---|---|---|---|
| 3,069,063 | A * | 12/1962 | King, Jr. et al. | 229/117 |
| 3,670,949 | A * | 6/1972 | Galanes | 229/120 |
| 3,933,300 | A * | 1/1976 | Dempster | 229/117.17 |
| 4,817,861 | A * | 4/1989 | Henrikson | 229/122 |
| 5,125,567 | A | 6/1992 | McClure | |
| 5,588,585 | A | 12/1996 | McClure | |
| 6,135,347 | A | 10/2000 | Mueller | |
| 6,149,052 | A * | 11/2000 | Mueller | 229/183 |
| 7,775,418 | B2 * | 8/2010 | Walling | 229/117.16 |
| 2005/0236466 | A1 | 10/2005 | McLeod | |

* cited by examiner

STORAGE BOX HAVING INTEGRAL LID WITH CLOSURE FLAPS

BACKGROUND OF THE INVENTION

1. Field of the Invention

The present invention relates to portable containers, in particular to corrugated paperboard containers with hingedly attached panels to form a lid.

2. Background Art

Corrugated paperboard boxes provide an exceptionally rugged, economical, and adaptable container for shipment and storage of goods. Because of the multi-ply construction of corrugated paperboard, the material is extremely lightweight for its stiffness. Nonetheless, the finishing or conversion of raw paper or corrugated board into a corrugated container commonly is accomplished at a location distant from the final use of the container. Hence, to economically transport the box, it must be shipped in an unassembled or knocked-down configuration. When products are to be placed in boxes in an industrial facility, the need to mechanically assemble the container with adhesives is readily addressed. Yet many boxes are used in the field, in homes, businesses, or agricultural settings, far from the jigs and wet adhesives of the factory floor. These boxes must be capable of being assembled without the need for post-manufacture adhesives. Such folding boxes are well known in the prior art.

A particular type of folding box includes a crash or automatic bottom that deploys into position to receive contents as the user unfold the box from its storage or flat configuration to the deployed configuration where the box is ready to receive contents. These boxes employ an arrangement of flaps and panels, which, by diligent manipulation by the end user, can be more or less rapidly assembled into a finished container. What is needed is a corrugated container which can be simply and rapidly assembled, and which has adequate levels of stacking strength.

While folding containers of the prior art may include lids, it is desirable to have a lid that is attached to the box and is easily secured and unsecured for the insertion and removal of the contents of the container. The box described herein includes side top flaps or panels that include closure flaps. The closure flaps inter with the hand holds of the box to secure the side top flaps in the closed position.

It is further noted that the box lid described herein can be utilized on other types of boxes, such as boxes that require taped or glued bottoms.

SUMMARY OF THE INVENTION

The corrugated paperboard box of this invention has two side panels which are joined by parallel end panels. The box includes a bottom extending between the upright side and end panels creating a volume or space to contain articles. In the preferred embodiment, the box bottom is a crash bottom in which automatic bottom panel extends from a side panel, and has two converging reverse-scored fold lines which extend between a side panel and the outer edge of the automatic bottom panel. End flaps are folded up from the automatic bottom panel and are adhesively connected to the end panels to form double ply side walls to the box. One of the end flaps has a diagonal fold line, with portions of the flap above the diagonal fold line only being adhered to the end panel. The angles of the reverse scored fold lines are selected depending on the dimensions of the box to allow the automatic bottom panel to be deployed from a folded position alongside the side and end panels to an assembled position perpendicular to the side and end panels, simply by displacing one side panel with respect to the other. The box is hence very simple to assemble and take down, yet has desirable stiffness and stacking strength due to the multi-ply assembly of the end walls. The end panels include hand holds preferably positioned near the top of the end panels. The handholds are preferably rectangular or trapezoidal apertures in the end panels.

The box has an open top area that may be selectively open and closed by the placement and removal of a lid. In the preferred embodiment, the otherwise open box may be closed by folding two overlapping side top flaps. One of the side top flaps includes closure flaps. When the side top flaps are positioned over the open top of the box to thereby close the box, the closure flaps extend downwardly from the side top flap to the handhold apertures of the end panels. The closure flaps are inserted into the hand hold apertures and folded upwardly about the top edge of the handhold aperture, thus securing the side top flaps in the closed position, and providing protection of the user's hands from the edges of the aperture forming the handholds.

It is an object of the present invention to provide a corrugated box with a securable lid which may be rapidly assembled from a knocked-down condition and is economical to construct.

It is yet another object of the present invention to provide a corrugated reusable box which may be readily closed and opened and reclosed, without strings or adhesives.

It is a still further object of the present invention to provide a corrugated box which is conveniently closed.

It is yet another object of the present invention to provide a knocked-down corrugated paperboard container with an integral reclosable lid, which can be assembled by applying pressure to the elongated ends of the knocked-down box.

It is still another object of the present invention to provide a corrugated container with an automatic bottom having four smooth, flat outside surfaces, and smooth flat, two-ply bottom surfaces.

It is also another object of the present invention to provide an automatic bottom box having several layers of corrugated board in the end walls to facilitate strong handholds for lifting the loaded box, and to provide structure to secure closure flaps inserted into handholds in the panels forming the end walls.

It is an object of the invention to create a box having two opposed end panels having handholds, two opposed side panels, and a bottom, assembled to form a box having an opening for receiving contents therein, the box including a top panel for closing the opening, the top panel being hingedly connected to a side panel, and including a pair of closure flaps extending from the side of the top panel, the closure flaps positioned to be inserted into the handhold when the top panel is positioned to close the box. The box may further including an end top flap hingedly connected to an end panel, the end top flap positioned generally parallel to the end panel when the box is closed, a closure flap having a distal portion positioned between the end panel and the end top flap when the closure flap is inserted into the handhold.

It is an object of the invention to create a corrugated paperboard article for assembly into a box, the article comprising:

a first side panel;

a first end panel which extends sidewardly from the first side panel, the first end panel having a handhold;

a second end panel which extends sidewardly from the first side panel spaced from the first end panel, the second end panel having a handhold;

a second side panel extending between and connected to the first end panel and the second end panel;

a first side top panel hingedly attached to the first side panel, the first side top panel including a pair of closure flaps extending from lateral sides of the top panel, the closure flaps positioned to be inserted into the handholds when the top panel is positioned to close the box;

a second side top panel hingedly attached to the second side panel;

an automatic bottom panel which extends from the first side panel along a bottom fold line, the automatic bottom panel having an outer edge which is substantially parallel to the bottom fold line and which is spaced from the bottom fold line, wherein a first fold line extends from the bottom fold line to the automatic bottom panel outer edge, and wherein a second fold line extends from the bottom panel fold line to the bottom panel outer edge, such that the first fold line and the second fold line converge toward one another and terminate at the bottom panel outer edge;

a first end flap which extends from the automatic bottom panel along a first end flap fold line, a first angle being defined between the first end flap fold line and the first fold line, wherein a portion of the first end flap is adhesively connected to the first end panel, to form a multi-ply end wall; and a second end flap which extends from the automatic bottom panel along a second end flap fold line, a second angle being defined between the second end flap fold line and the second fold line, wherein a diagonal fold line extends along the second end flap, dividing the second end flap into an upper portion which is adhesively connected to the second end panel, and a lower portion below the diagonal fold line which is not connected to the second end panel, wherein parallel sideward displacement of the first side panel with respect to the second side panel causes the article to expand into a box, with the automatic bottom panel being alternatively positioned in a collapsed position alongside and substantially parallel to the side and end panels, and an assembled position substantially perpendicular to the side and end panels.

Further objects, features and advantages of the invention will be apparent from the following detailed description when taken in conjunction with the accompanying drawings.

DETAILED DESCRIPTION OF THE PREFERRED EMBODIMENT

Referring more particularly to the figures wherein like numbers refer to similar parts, a corrugated paperboard box 20 of this invention having an integral lid formed of hingedly attached side top flaps 74 and 75 is shown. The box 20 is formed in a knocked-down condition at the factory from a single corrugated paperboard blank 22, shown in FIGS. 1 and 2. The blank 22 is cut, folded, and adhesively connected such that the knocked-down article is readily expandable into a box with minimal effort by the end user and without the need for the end user to use connectors or adhesives in the final box assembly. One skilled in the art will recognize that the side top flap having closure flaps can be used on other types of boxes having four walls, a bottom, and apertures in two of the walls, and is not limited to crash bottom boxes.

Figure 1:
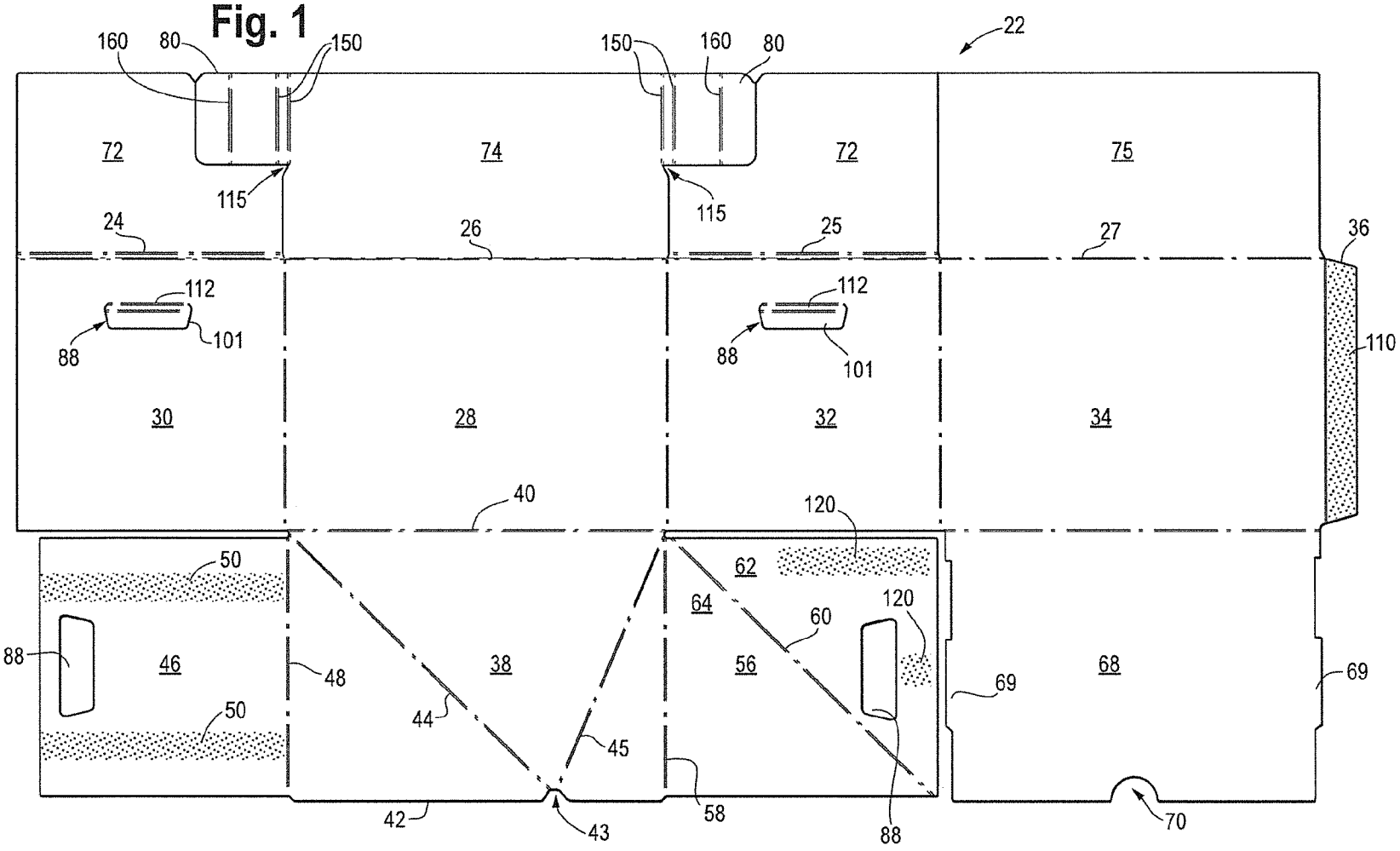
FIG. 1 is a plan view of a first side of a blank used to form the box.

For the preferred embodiment crash bottom box, the blank 22, as shown in FIGS. 1 and. 2, is for the fully enclosable box 20. The blank 22 is a single thickness of conventional corrugated paperboard, having one, two, or more plies of corrugations, depending on the ultimate strength required. One skilled in the art of containers will recognize that the other types of material used to make containers, such as plastic, coated fiberboard, and cardboard, may be used to form the blank 22. When corrugated paper board is used, it is preferred that the corrugations are positioned to run perpendicular to the fold line 26 between the first side top panel 74 and the first side panel 28. The blank 22 is die-cut and folded to minimize waste or unutilized segments of corrugated paperboard.

The box 20 is preferably generally rectangular, and therefore the blank 22 has a rectangular first side panel 28, with a first end panel 30 extending along a fold line on one side of the first side panel, and a second end panel 32 extending along a fold line on the other side. A second side panel 34, of dimensions similar to the first side panel 28, extends along a fold line from the second end panel 32. A glue flap 36 extends from the second side panel 34 along a fold line. The glue flap 36 is adhesively connected to the interior of the first end panel 30. The zone of adhesion is indicated by stippling 110. It should be noted that the glue flap 36 may alternatively be connected to the exterior of the first end panel 30. The side panels and the end panels form the vertically extending side walls of the assembled box 20, as shown in FIGS. 3-7A. It is preferred that the corrugations of the corrugated fiberboard run in the vertical direction in the vertically extending side walls of the assembled box 20.

An automatic bottom panel 38 extends from the first side panel 28 along a bottom fold line 40. The automatic bottom panel 38 is generally rectangular with a width approximately equal to the horizontal width of the side panels, and a length approximately equal to the horizontal width of the side panels. The automatic bottom panel 38 has an outer edge 42 which is spaced generally parallel from the bottom fold line 40. A first diagonal fold line 44 extends from the bottom fold line 40 to the outer edge 42. The first diagonal fold line 44 is preferably a reverse scored fold line, but may be formed in other ways to create a line of weakness suitable for folding. Such lines of weakness may be scored lines or perforations. The first diagonal fold line 44 is positioned at about 45 degrees from the bottom panel fold line 40. A second diagonal fold line 45 extends from the bottom panel fold line 40 the outer edge 42. The second diagonal fold line 45 is preferably a reverse scored fold line, but may be formed in other ways to create a line of weakness suitable for folding. Such lines of weakness may be score lines or perforations. The first diagonal fold line 44 converges toward the second diagonal fold line 45. It is preferred that the outer edge 42 is notched in the area where the first diagonal fold line 44 and the second diagonal fold line 45 are nearest to each other. The notch has generally curved shape to reduce the concentration of stresses. When the box 20 has side panels which are less than twice the width of the end panels, the first diagonal fold line 44 and the second diagonal fold line 45 or extensions of those lines, will meet along a unnotched extension of outer edge 42 if the outer edge 42 is notched 43, or at outer edge 42 if the outer edge 42 is not notched. For boxes of different dimensions, the two diagonal fold lines may terminate at different positions along the outer edge. Nevertheless, the angle of the first diagonal fold line 44 will always be about 45 degrees.

A generally rectangular first end flap 46 extends from the automatic bottom panel 38 along a first end flap fold line 48. A first angle is defined between the first end flap fold line 48 and the first diagonal fold line 44. An attachment region 50, indicated in FIGS. 1 and 2 by a stippling pattern, is defined on the exterior face of the first end flap 46. In manufacture of the box 20, adhesive is applied to the attachment region 50 and the first end flap 46 is glued to the first end panel 30 to form a multi-ply end wall 52. The zone of contact where the adhesive is applied is shown as stippling 130. In alternate embodiments, the entire surfaces of the end flaps which do not move with respect to the end panels may be adhered together.

A generally rectangular second end flap 56 extends from the automatic bottom panel 38 along a second end flap fold line 58. A second angle of approximately 45 degrees is defined between the second end flap fold line 58 and the second fold line 45 on the automatic bottom panel 38. In order for the automatic bottom panel 38 to be free to collapse, the second end flap 56 cannot be fully connected to the second end panel 32. The second end flap 56 is therefore formed with an end flap diagonal fold line 60 which extends at a 45 degree angle from the bottom edge of the flap along the second end flap from a point adjacent the intersection of the second diagonal fold line 45 and the bottom fold line 40. The end flap diagonal fold line 60 thus divides the second end flap 56 into an upper portion 62 which is adhesively connected to the second end panel 32, and a lower portion 64 below the diagonal fold line which is not connected to the second end panel. Adhesive is applied to the exterior face of the upper portion 62 of the second end flap 56 and brought into contact with the second end panel to connect the second end flap to the second end panel and create a second multi-ply end wall 66. The zones of contact created by the adhesive are shown by stippling 120. The end flaps 46, 56, extend the full depth of the box to better contribute to the stacking strength of the box.

The automatic bottom panel, fixed to one end panel, and fixed along a diagonal fold line to the other panel, may thus be extended between a collapsed position alongside and substantially parallel to the side and end panels, and an assembled position substantially perpendicular to the side and end panels. As shown in FIGS. 3-7A, this transformation of the finished blank from a compact, flat, corrugated assembly, to a dimensional storage box is effected by displacing the first side panel with respect to the second side panel, by, for example, gripping the flat assembly at the corners and applying pressure towards the interior of the assembly. This manipulation causes the article to expand into a box.

Figure 4:
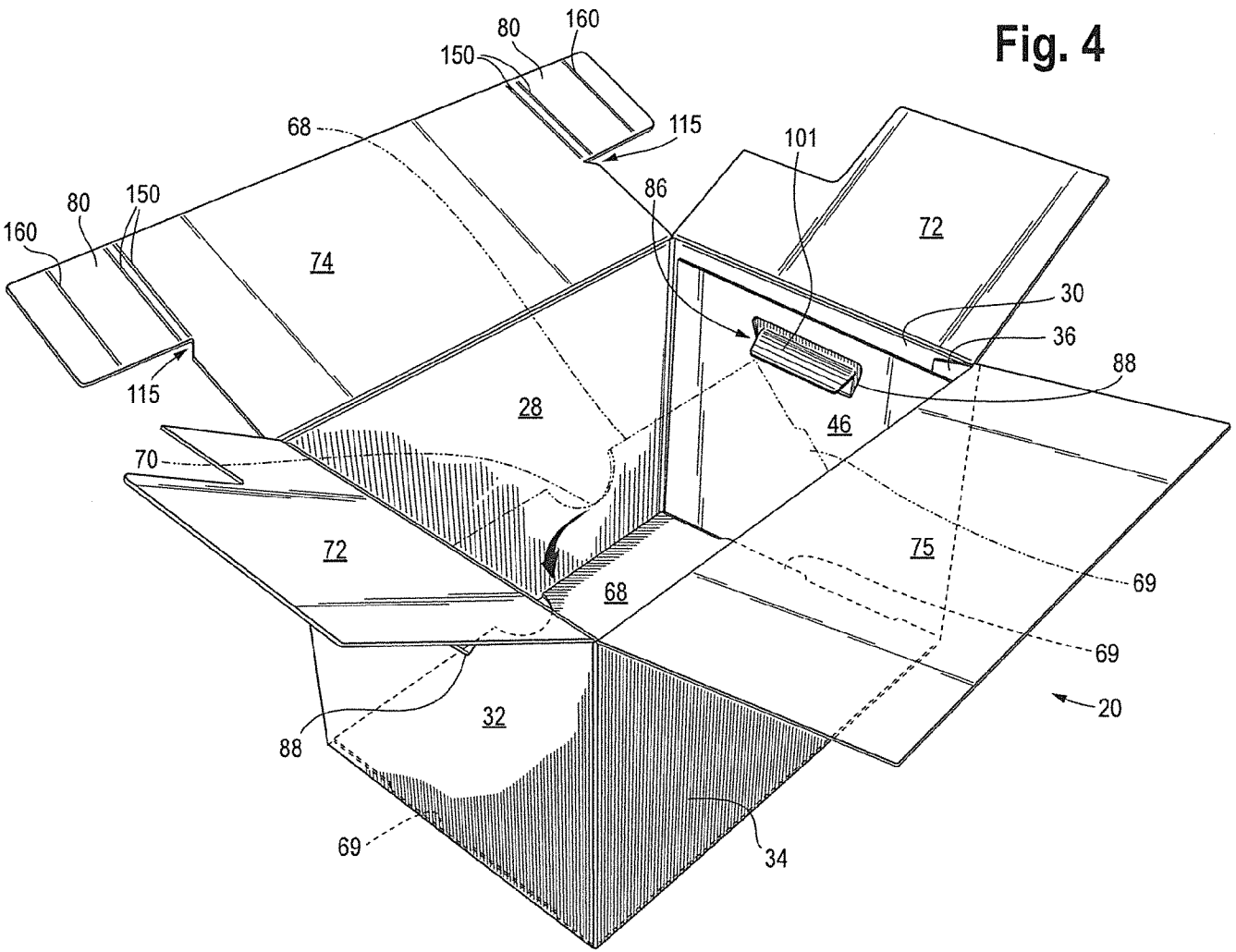
FIG. 4 is a top perspective view of an almost fully deployed box, showing the inner bottom panel being placed.
Figure 5:
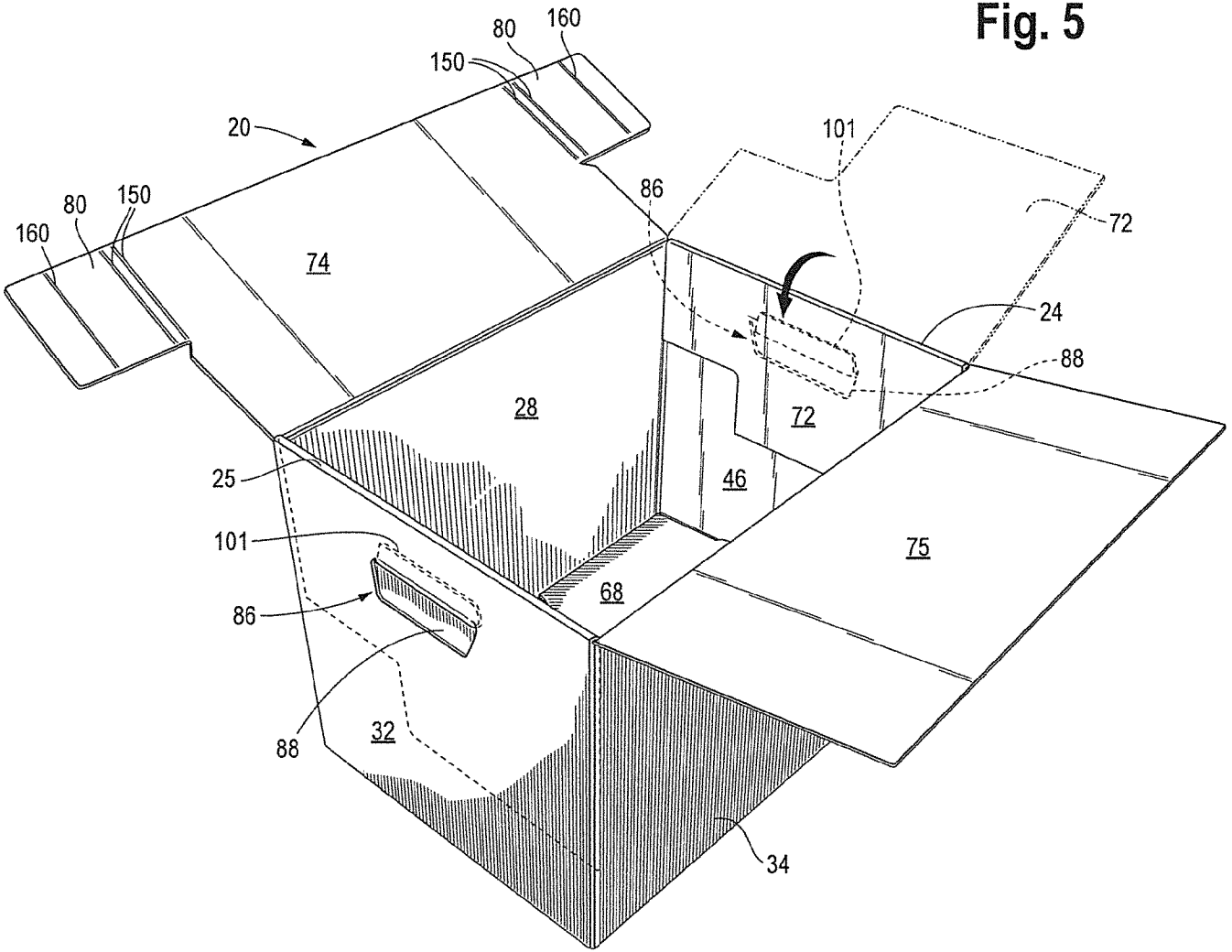
FIG. 5 is a top perspective view of the deployed box showing the top end panels being folded into the box and placed generally parallel to the end panels, and the flaps of material in the handholds pushed into the box and around the end flaps, positioning the flaps of material between the end flaps and the top end flaps.

An interior bottom panel 68 extends along a fold line from the second side panel 34. The interior bottom panel 68 has approximately the same dimensions at the automatic bottom panel 38, and, in the knocked-down position, lies adjacent and between the folded side panels 28, 34. After the box 20 has been expanded so that the automatic bottom panel 38 forms the horizontal bottom of the box, the interior bottom panel 68 is pivoted downwardly to overlie the automatic bottom panel and there defines a flat, uncreased bottom to the box, as shown in FIG. 4. The interior bottom panel 68 may include tabs 69 along the end edges to secure the interior bottom panel 68 in position by causing friction with the end flaps 46 and 56. To facilitate collapsing of the box 20 subsequent to assembly, the interior bottom panel may be provided with a finger opening cut-out 70 along its perimeter to permit a user to reach beneath the interior bottom panel, and fold it back along the second side panel 34, thereby permitting the box to be collapsed by applying upward pressure on the automatic bottom panel 38.

Figure 2:
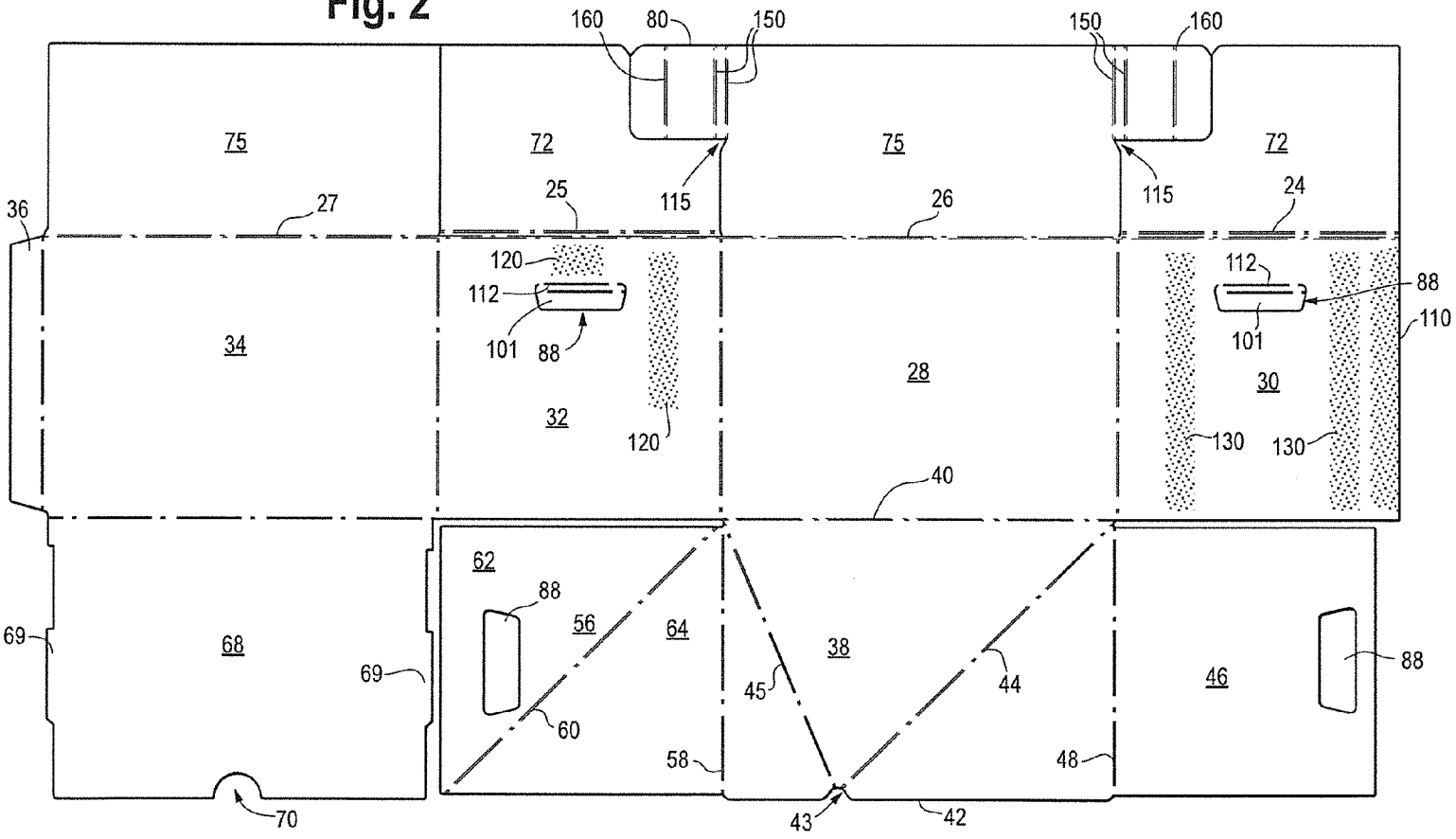
FIG. 2 is a plan view of a second side of a blank used to form the box.
Figure 3:
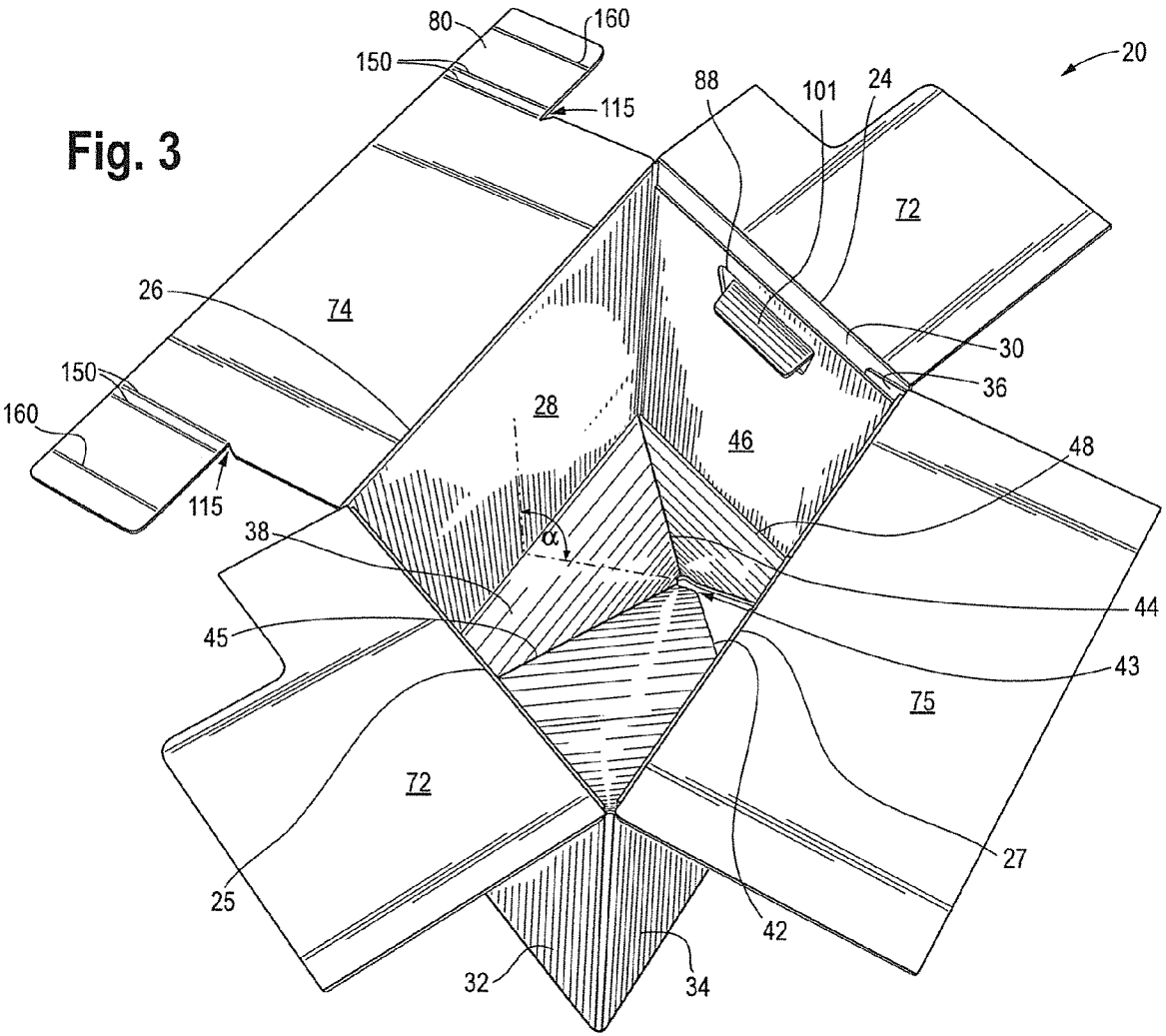
FIG. 3 is top perspective view of a partially deployed box showing the inside of the box through the top opening and the floor partially deployed.

The box 20 described herein is provided with a convenient closure to close, cover, or seal the box 20 and protect or contain the contents. As shown in FIGS. 1 and 2, an end top flap 72 extends upwardly from each end panel 32, 34. The end top flaps 72 are sized slightly narrower in width (width for the end panels being the direction of the double fold lines 24 and 25) than the end panels 32 and 34 to allow for the end top flaps 72 to be folded into the open box about double fold lines 24 and 25 so that the end top flaps 72 rest nearly parallel to the end panels 32 and 34. In such a position, the end top flaps 72 are generally vertical. Such an arrangement is not necessary, but has the benefit of strengthening the box and can provide force against the closure flaps 80 when the closure flaps 80 are inserted in the handholds 86. In an alternate arrangement, the end top flaps 72 are folded about the double fold lines 24 and 25 so that they rest horizontally or are generally perpendicular to the end panels 32 and 34 to cover at least a portion of the opening of the box.

Figure 6A:
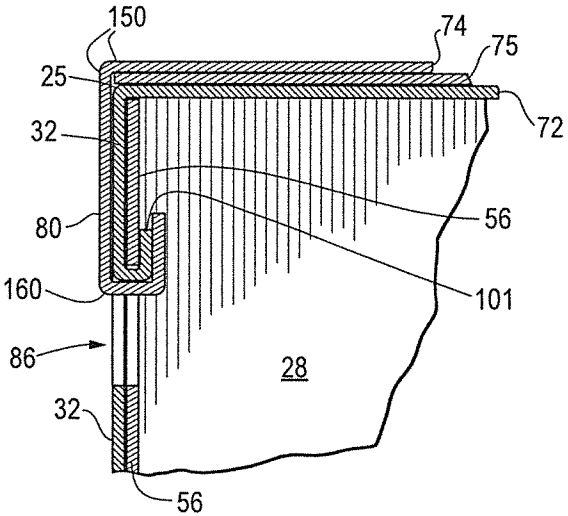
FIG. 6A is a partial sectional view of the box in FIG. 6.
Figure 6:
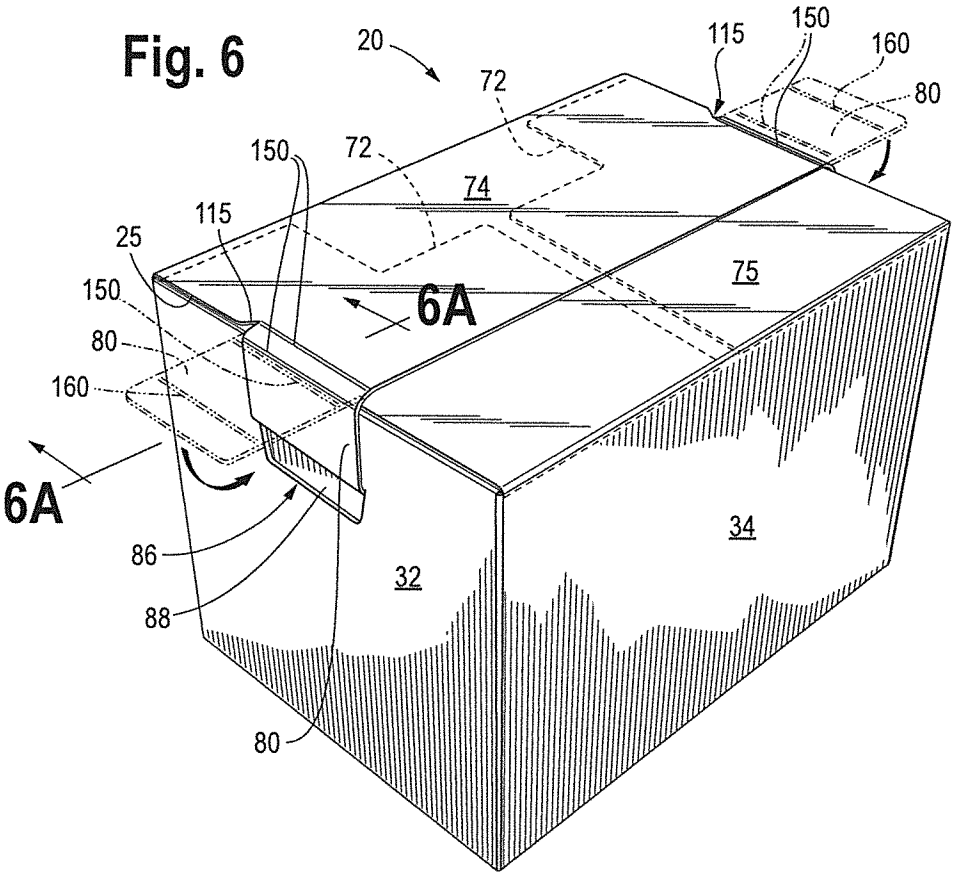
FIG. 6 is a perspective view of a closed box with the top end panels in a horizontal position, showing the closure flaps in the handholds.

A first side top flap 74 extends from the first side panel 28. A second side top flap 75 extends from the second side panel 34. The first side top flap 74 height is generally is greater than one half the width of the box 20. The second side top flap 75 is generally of the same height due to the economies of maximizing the material used for the blank, but need not be the same size. The height of the side top flaps 74 and 75 is the dimension perpendicular to fold line 26. Thus, when the side top flaps 74 are folded down to form a cover or lid for the otherwise open box 20, as shown in FIGS. 6 and 7, the first and second side top flaps 74 and 75 lie one atop the other, with the first side top flap 74 being positioned on the outside of the box 20, forming an exterior surface of the box 20.

The box 20 is provided with handholds 86 for convenient lifting and transporting of the box. A handhold 86 is defined in each end wall 52, 66, by aligned apertures 88 in the end panels 30, 32 and the end flaps 46, 56. It is preferred that the apertures 88 in the end flaps are slightly larger than the apertures 88 in the end panels 30 and 32. It is also preferred that the handholds 86 in the end panels 30 and 32 each include a flap of material 101 hingedly attached to the end panel. The flap of material 101 is created by die cutting the aperture 88 in each end panel 30 and 32 about only part of the perimeter of each aperture 88. Preferably, the top portion of the perimeter is not cut, thereby creating a flap of material 101 that can be pushed through the apertures in both the end panels and the end walls. In the preferred embodiment, the top portion of the perimeter is defined by double fold lines 112. When the user desires to use the handholds 86, he pushes the flap of material 101 into the aperture 88. The flap of material 101 provides a more comfortable experience from the user as the flap of material shields the users hands from the top edge of the apertures 88. In the embodiment where the end panel top flaps 72 are folded nearly parallel to the end panels 30 and 32, the flap of material 101 is folded upward once pushed into the apertures of the end panel and the end flap so as to rest between the end panel top flap 72 and the end flaps 46 or 56, as shown in FIG. 6A. Because the handholds 86 are formed in double thicknesses of corrugated paperboard and also include the flaps of material 101, the box is better able to support the loads imposed by lifting at the handholds.

As shown in the FIGS. 1 and 2, the first side top flap 74 has a sidewardly extending closure flap 80 on each lateral side of the first side top flap 74. The material for the closure flaps 80 is preferably provided by making the side edge die cut non linear and cutting material out of what would otherwise be a rectangular end top flap 72. Because the closure flaps 80 extend sidewardly, rather than upwardly, they do not extend the height of folded article when it is in its collapsed configuration. It is preferable that the first side top panel 74 include stress relief notches 115 where the closure flaps 80 meet the side edges of the first side top panel 74.

The closure flaps 80 are sized so that their width (where width is the direction parallel to fold line 27) is slightly larger than the width of the upper portion of the aperture 88 in the end panel 30 or 32 forming the handholds 86. The closure flaps 80 are of sufficient length to reach to at least the top of the handholds 86 when the first top side flap 74 is placed over the top of the box 20 in a closed position, as shown in FIGS. 6 and 7. It is preferable that the length of the closure flaps 80 is sufficient to reach to the bottom of the handhold 86 apertures 88 in the end panels 30 and 32.

Figure 7A:
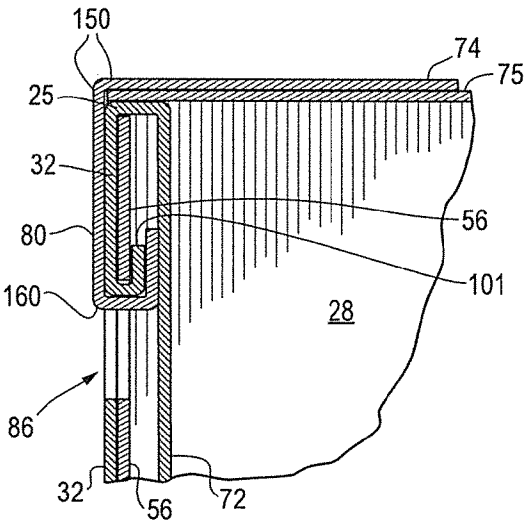
FIG. 7A is a partial sectional view of the box of FIG. 7.
Figure 7:
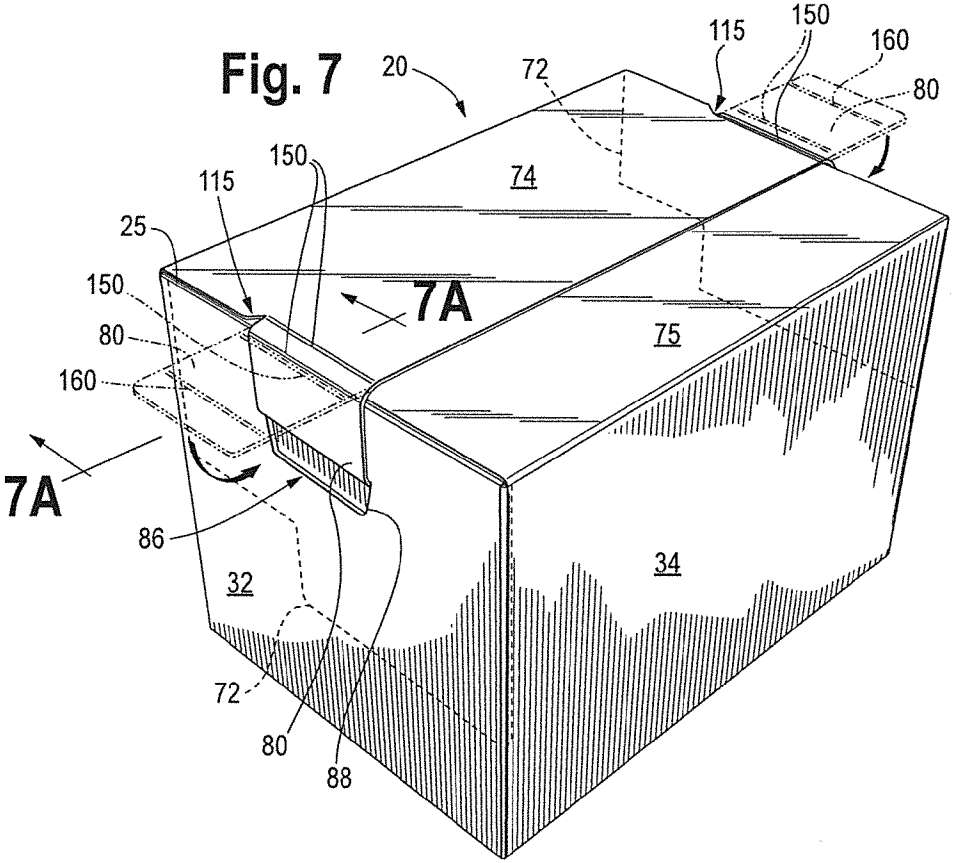
FIG. 7 is a perspective view of a closed box with the top end panels in a vertical position, showing the closure flaps in the handholds.

In use, the closure flaps 80 are pushed in to the apertures 88 of the handholds 86 and folded upwards when the user lifts the box 20 by the hand holds 86 as shown in FIGS. 6-7A. It is preferable that the closure flaps are retained in the handholds 86 by friction between the closure flaps 80 and the sides of the apertures 88. This occurs because the closure flaps 80 are slightly wider in width than the apertures 88 of the end panels 30 and 32. The closure flaps 80 can include fold lines to allow the closure flaps to bend around the panels as shown in FIGS. 6A and 7A. In the blank 22 shown in FIGS. 1 and 2, each closure flap has a first double fold line 150 nearest the first top side panel 74, and a second fold line 160 distal there from. The second fold line 160 is positioned to lie where the closure flap 80 bends to enter the handhold. Thus the distance between the first double fold line 150 and the second fold line 160 is the distance between the top of the handhold 86 and the top edge of the end panel 30 or 32. One skilled in the art will recognize that the first double fold line 150 and the second fold line 160 optional when the corrugations of the material used to form the blank run parallel to those lines, thereby easily allowing folding along the corrugations.

It should be noted that the fold lines which have been discussed above as fold lines or score lines, may also be perf rolled, or otherwise treated to permit folding of portions of the box 20 in the directions desired.

It is understood that the invention is not limited to the particular construction and arrangement of parts herein illustrated and described, but embraces such modified forms thereof as come within the scope of the following claims.

The invention claimed is:

1. A box having two opposed end panels each having handholds, two opposed side panels, and a bottom, assembled to form a box having an opening for receiving contents therein, the box including a top panel for closing the opening, the top panel being hingedly connected to a side panel, and including a pair of closure flaps extending from lateral sides of the top panel, the closure flaps positioned to be inserted into the handholds when the top panel is positioned to close the box, wherein the bottom of the box is a crash bottom, the crash bottom including an automatic bottom panel which extends from a first side panel selected from the opposed side panels, the automatic bottom panel extending along a first bottom fold line, the automatic bottom panel having an outer edge which is substantially parallel to the first bottom fold line and which is spaced from the first bottom fold line, wherein a first fold line extends from the first bottom fold line to the automatic bottom panel outer edge, and wherein a second fold line extends from the first bottom panel fold line to the bottom panel outer edge, such that the first fold line and the second fold line converge toward one another and terminate at the bottom panel outer edge; and an interior bottom panel which extends from a second side panel selected from the opposed side panels, the interior bottom panel extending along a second bottom fold line, the interior bottom panel having lateral edges generally perpendicular to the second bottom fold line, the lateral edges including tabs that extend beyond the lateral edges.

2. A corrugated paperboard article for assembly into a box, the article comprising:

a first side panel;

a first end panel which extends sidewardly from the first side panel, the first end panel having a handhold;

a second end panel which extends sidewardly from the first side panel spaced from the first end panel, the second end panel having a handhold;

a second side panel extending between and connected to the first end panel and the second end panel;

a first side top panel hingedly attached to the first side panel, the first side top panel including a pair of closure flaps extending from lateral sides of the top panel, the closure flaps positioned to be inserted into the handholds when the top panel is positioned to close the box;

a second side top panel hingedly attached to the second side panel;

an automatic bottom panel which extends from the first side panel along a bottom fold line, the automatic bottom panel having an outer edge which is substantially parallel to the bottom fold line and which is spaced from the bottom fold line, wherein a first fold line extends from the bottom fold line to the automatic bottom panel outer edge, and wherein a second fold line extends from the bottom panel fold line to the bottom panel outer edge, such that the first fold line and the second fold line converge toward one another and terminate at the bottom panel outer edge;

a first end flap which extends from the automatic bottom panel along a first end flap fold line, a first angle being defined between the first end flap fold line and the first fold line, wherein a portion of the first end flap is adhesively connected to the first end panel, to form a multi-ply end wall; and a second end flap which extends from the automatic bottom panel along a second end flap fold line, a second angle being defined between the second end flap fold line and the second fold line, wherein a diagonal fold line extends along the second end flap, dividing the second end flap into an upper portion which is adhesively connected to the second end panel, and a lower portion below the diagonal fold line which is not connected to the second end panel, wherein parallel sideward displacement of the first side panel with respect to the second side panel causes the article to expand into a box, with the automatic bottom panel being alternatively positioned in a collapsed position alongside and substantially parallel to the side and end panels, and an assembled position substantially perpendicular to the side and end panels, the box further including an interior bottom panel which extends from the second side panel, the interior bottom panel extending along a second bottom fold line, the interior bottom panel having lateral edges generally perpendicular to the second bottom fold line, the lateral edges including tabs that extend beyond the lateral edges.

* * * * *